US007425245B2

(12) United States Patent
Waters

(10) Patent No.: US 7,425,245 B2
(45) Date of Patent: Sep. 16, 2008

(54) FIBROUS SHEETS

(75) Inventor: Anthony James Waters, Bath (GB)

(73) Assignee: De La Rue International Limited, Basingstoke (GB)

( * ) Notice: Subject to any disclaimer, the term of this patent is extended or adjusted under 35 U.S.C. 154(b) by 0 days.

(21) Appl. No.: 10/513,674

(22) PCT Filed: May 9, 2003

(86) PCT No.: PCT/GB03/01971

§ 371 (c)(1),
(2), (4) Date: Nov. 8, 2004

(87) PCT Pub. No.: WO03/095188

PCT Pub. Date: Nov. 20, 2003

(65) Prior Publication Data

US 2005/0173086 A1 Aug. 11, 2005

(30) Foreign Application Priority Data

May 9, 2002 (GB) ..... 0210680.5

(51) Int. Cl.
*D21F 11/06* (2006.01)
*D21H 21/42* (2006.01)

(52) U.S. Cl. ..... 162/103; 162/114; 162/116; 162/296; 162/300; 162/314

(58) Field of Classification Search ..... 162/140, 162/103, 114, 116, 296, 300, 314
See application file for complete search history.

(56) References Cited

U.S. PATENT DOCUMENTS 987,678 A * 3/1911 Howes ..... 162/126

(Continued)

FOREIGN PATENT DOCUMENTS

EP 0059056 * 9/1982

(Continued)

OTHER PUBLICATIONS

Machine Translation of JP-2001-172897 A, Industrial Property Digital Library [online] [retrieved on Jun. 17, 2007] Retrieved from the Internet:<URL:http://www4.ipdl.inpit.go.jp/Tokujitu/PAJdetail.ipdl?N0000=60&N0120=01&N2001=2&N3001=2001-172897>.*

*Primary Examiner*—Eric Hug
*Assistant Examiner*—Dennis Cordray
(74) *Attorney, Agent, or Firm*—Dykema Gossett PLLC

(57) ABSTRACT

This invention is directed to improvements in fibrous sheets, such as paper, incorporating an elongate impermeable element, to a method of making such paper and to documents made therefrom. The method comprises the steps of bringing an elongate flexible element into contact with a moving support surface, and depositing fibers onto the support surface to form a fibrous sheet which travels in a machine direction. The said support surface has spaced portions which prevent the substantial deposition of fibers at those portions and form windows at spaced locations in at least one surface of the sheet. The deposition of fibers is carried out in such a manner that as fibers are deposited onto the support surface the elongate element is incorporated in the sheet with regions of the element at least partially exposed at at least one surface of the sheet at said windows. At least a leading edge of the spaced portions is at an angle, in the plane of the sheet, which is not 90° to the machine direction.

13 Claims, 3 Drawing Sheets

U.S. PATENT DOCUMENTS

| | | | | | |
|---|---|---|---|---|---|
| 5,093,184 | A | * | 3/1992 | Edwards | 428/195.1 |
| 5,405,500 | A | | 4/1995 | Knight | |
| 5,783,275 | A | | 7/1998 | Mück et al. | |
| 6,616,803 | B1 | | 9/2003 | Isherwood et al. | |

FOREIGN PATENT DOCUMENTS

| | | | |
|---|---|---|---|
| JP | 2001-172897 | * | 6/2001 |
| WO | 0039391 | | 7/2000 |
| WO | WO 03/040466 | * | 5/2003 |

* cited by examiner

FIBROUS SHEETS

This application is a 371 of PCT/GB03/01971, filed May 9, 2003, which claims benefit of United Kingdom Application No. 0210680.5, filed May 9, 2002.

This invention is directed to improvements in fibrous sheets, such as paper, incorporating an elongate impermeable element, to a method of making such paper and to documents made therefrom.

It is generally known to include elongate security elements in security paper, as a security feature. Such elements can be threads, strips or ribbons of, for example, plastics film, metal foil, metallised plastic, metal wire. These security elements are included in the thickness of security paper to render imitation of documents produced from the paper more difficult. These elements help in the verification of security documents as they render the view of the documents in reflected light different from that in transmitted light. To increase the security provided by the inclusion of such an elongate element, it is also known to endow the element itself with one or more verifiable properties over and above its presence or absence. Such additional properties include magnetic properties, electrical conductivities, the ability to absorb x-rays and fluorescence.

As a further security feature, it has been found to be particularly advantageous to provide windows in one side of the surface of the paper, which expose such elongate elements at spaced locations. Examples of methods of manufacturing such paper incorporating security elements with or without windows are described below. It should be noted that references to "windowed thread paper" include windowed paper incorporating any elongate security element.

EP-A-0059056 describes a method of manufacture of windowed thread paper on a cylinder mould paper-making machine. The technique involves embossing the cylinder mould cover and bringing an impermeable elongate security element into contact with the raised regions of an embossed mould cover, prior to the contact entry point into a vat of aqueous stock. Where the impermeable security element makes intimate contact with the raised regions of the embossing, no fibre deposition can occur. After the paper is fully formed and couched from the cylinder mould cover, the water is extracted from the wet fibre mat and the paper is passed through a drying process. In the finished paper the contact points are present as exposed regions which ultimately form windows, visible in reflected light, on one side of a security or banknote paper.

WO-A-93/08327 describes a method of manufacturing windowed thread paper on a Fourdrinier paper-making machine. A rotating embedment means, with a modified profile for embossing, is used to drive an impermeable elongate security element into draining paper stock, on a Fourdrinier wire. The profile of the embedment means is such that raised portions are provided which remain in contact with the security element during the embedment process. Thus, paper fibres are prevented from collecting between the security element and embedment means, such that the security element is subsequently exposed in windowed regions of paper.

In the manufacture of many security papers, it is desirable to press the water out of the paper by using single felted presses as these tend to give a superior printing surface due to the application of plain press roll surfaces to the surface of the paper. Typically the first press and second press have a reverse configuration with respect to the side to which the unfelted roll is applied, thereby giving both surfaces a smoothing effect.

In all of the prior art methods described above, the width of the elongate element which can be used is very limited. Furthermore, the areas of the elements which are exposed are restricted in terms of shape, due to the limitation imposed by the required embossings, and in terms of the areas, due to the nature of the paper-making technique itself.

For many applications a considerable advantage can be obtained if the impermeable element is over 2 mm wide and more preferably having a width of 4 mm or greater.

Another of the main difficulties associated with the manufacture of paper incorporating wide security elements, i.e. over 2 mm wide, is water removal at first press when the press is only felted on one side. When the paper is squeezed between the rolls it seeks to flow along the route of least resistance. On the side in contact with the felt the water passes into the voids of the felt and does no harm to the paper structure. On the side in contact with the unfelted roll, as the paper passes through the press the wet fibres that are sandwiched between the unfelted press roll and the wide element tend to split apart, forming small rivulets in the machine direction along which the squeezed out water passes.

This effect is especially noticeable with a windowed security element, where the splits appear as defects in the paper bridges between the windows at the point where the bridges cover the security element. This commonly occurs if the first press nip comprises a plain roll in contact with the windowed side of the paper and a felt in contact with the other side.

One way in which this limitation has been overcome is by using a double felted first press nip. This allows the accommodation of various press technologies, including the combi-press, in which two press nips are achieved in combination with only three rolls. In this way the felts accommodate water being squeezed from both sides of the sheet and the splitting effect of a wide security element as described above is avoided. This can, however, result in a compromise of the paper surface as now only one side of the paper can benefit from the smoothing effect of the unfelted roll.

It is therefore an object of the present invention to provide a method of manufacturing fibrous sheets, such as paper, which can be used with wide security elements, as well as narrower security elements, in which the quality of the printing surface is not compromised where a single felted press machine is used.

The invention therefore provides a method of manufacturing a fibrous sheet comprising the steps of bringing an elongate flexible element into contact with a moving support surface provided with spaced portions for forming windows and depositing fibres onto the support surface to form a fibrous sheet which travels in a machine direction; the deposition of fibres being carried out in such a manner that as fibres are deposited the elongate element is incorporated in the sheet with regions of the element exposed with windows at spaced locations in at least one surface of the sheet, wherein at least a leading edge of the spaced portions is at an angle, in the plane of the sheet, which is not 90° to the machine direction, characterised in that the spaced portions are formed by embossing and raised relative to adjacent areas of the support surface and are fluid permeable, such that where the elongate element makes intimate contact with the raised spaced portions no fibre deposition can occur leaving the element exposed and further in that the windows extend beyond the width of the elongate element.

The invention will now be described, by way of example only, with reference to the accompanying drawings in which.

The method of manufacturing a fibrous sheet, such as paper, according to the present invention is illustrated with reference to FIGS. 1 and 2. A porous support surface, for example in the form of a cylinder mould cover 10, is produced in a known way. The mould cover 10 has raised portions 12 formed by embossing, such as those described in EP-A-0059056. The raised portions 12 are spaced around the mould cover 10 and define the shape of the windows 16 formed in the final paper 15. In this specification the term "window" includes a transparent or translucent region in the paper of a predefined shape and occurrence.

Figure 1:
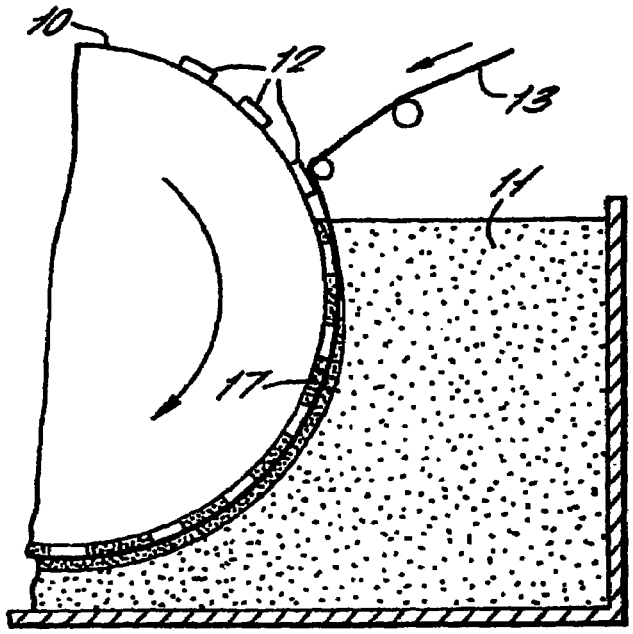
FIG. 1 is a cross-sectional side elevation of a schematic of a paper-making vat for use in the method of manufacturing paper according to the present invention.

In a known manner, the cylinder mould cover 10 is rotated in a vat of paper stock 11 as illustrated in FIG. 1, and fibres are continuously deposited thereon in a known manner to form a continuous web of paper. The paper stock may comprise fibres of natural materials, such as cotton, synthetic fibres or a mixture of both. As the cylinder mould cover 10 rotates, a flexible elongate impermeable element (or thread) 13, is brought into contact with the cylinder mould cover 10 above the level of the paper stock. As the mould cover 10 rotates, the elongate element 13 is introduced into the paper stock, and is partially embedded in the paper as it forms. The continuous paper sheet (or web) is moved along continuously as it is formed, its direction of travel being known as the "machine direction".

The elongate element 13 may be wide enough to provide a wide security thread i.e. greater than 2 mm, and potentially greater than 6 mm, but preferably 4 mm. Alternatively it may be narrow to provide a more traditional narrow security thread, having a width of 0.5 mm to 2 mm.

Figure 2:
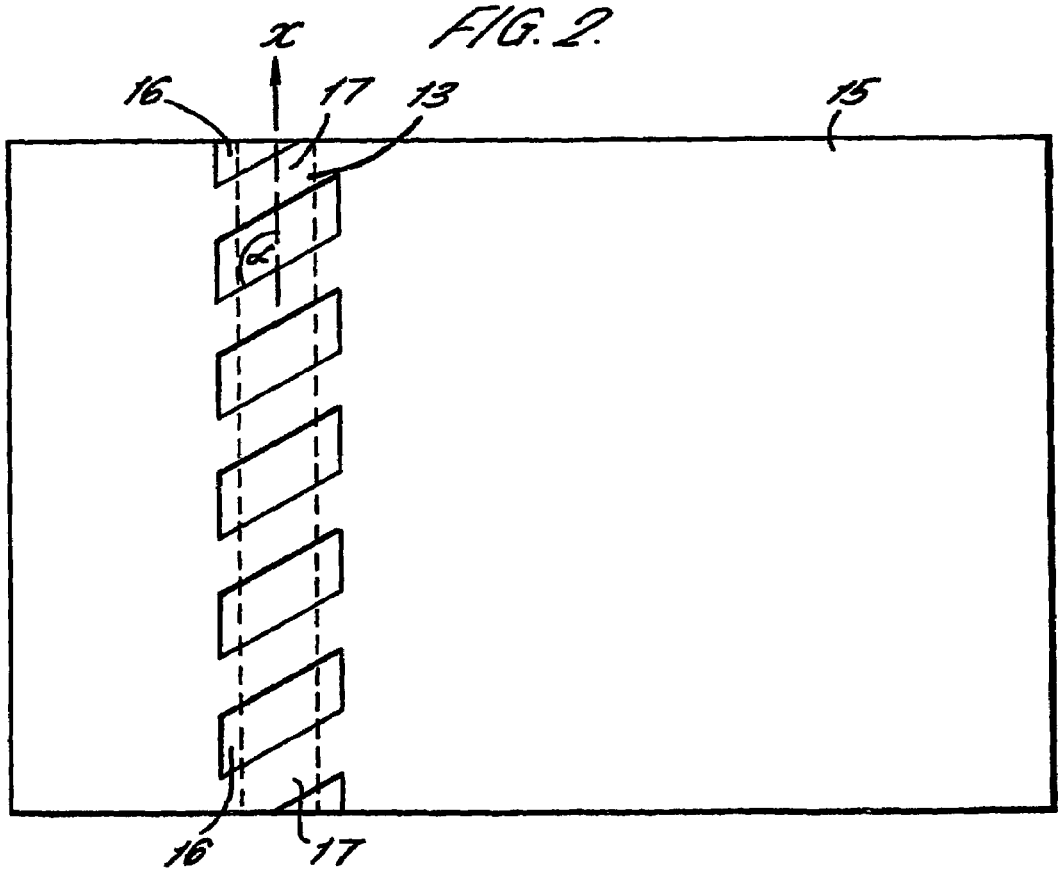
FIG. 2 is a plan view of a sheet of paper made according to the present invention.

The method of the present invention differs from prior art methods in that the configuration of the raised portions 12 is modified with the effect that can be seen in FIG. 2. In FIG. 2 there is shown a small sheet of paper 15 cut from a continuous sheet of paper formed as described above, containing the partially embedded elongate element 13 which is exposed in the windows 16. Between the windows 16 are bridges 17 of paper which cover the elongate element 13. However, in all of the known prior art methods of paper making the raised portions 12, which effects the formation of the windows 16 and bridges 17, are square or rectangular and are positioned with their leading and trailing edges perpendicular to the machine direction. In this method, on the other hand, raised portions 12 have at least their leading edge formed at any angle other than 90° to the machine direction. As a result at least the leading edges of the bridges 17 are formed at an angle $\propto$ other than 90° to the machine direction (shown as arrow x). In a further embodiment of the invention both the leading and trailing edges of the raised portions 12, and thus the bridges 17 as they are formed, are at an angle other than 90° to the machine direction.

The preferred angles $\propto$ of the leading (and potentially also the trailing) edges of the raised portions 12, and therefore the bridges 17, are 30°, 45° or 60° to the machine direction, but any angle other than 90° can be used.

Thus, during the paper making process, as each bridge 17 is passed through the press section of the machine, only a part of the bridge 17 is actually in the nip at any one time. The consequence of this is that water squeezed out of the paper in the nip migrates to the non-bridge area and is channelled harmlessly away along these angled windowed areas of the elongate element 13, instead of being forced along through the bridges 17.

This new window configuration can also result in other surprising benefits. It is a feature of the method as described in EP-A-0059056 that the embossed mould cover is gradually flattened by constant use under the impact of the couch roll which forms a nip with the mould cover at the point where the paper is transferred to the Formex, (which is a flexible belt which transfers the paper to the next part of the paper making machine). This significantly reduces the mould cover life and leads to significant costs in repair and replacement. However, by angling the raised portions 12 in accordance with the present invention and positioning them sufficiently closely to adjacent portions 12, the couch roll does not repeatedly impact the embossed raised portion 12 with such a high force as it always rides on at least one raised portion 12 and the mould cover life is thus significantly increased. For a similar reason, the defect known as "barring" is also eliminated as the couch roll cannot fall within the troughs between the embossings as it does when the raised portions 12 are perpendicular to the machine direction and therefore parallel to the troughs. It should be noted, however, that the relative positioning of the raised portions 12 to each other is a preferred not an essential feature of the invention.

Furthermore, because the wire mesh of the mould cover is aligned in such a way that the weft and warp of the weave correspond to the cross- and machine-directions of the paper machine, the raised portions 12 of the traditional method of EP-A-0059056 are weakened by virtue of the wire mesh being aligned in the same direction as the forces acting on it. By angling the raised portions 12 in the present invention, the wire mesh forms a diagonal structure in relation to the forces acting on the raised portions 12. This structure is mechanically stronger and results in longer mould cover life.

Figure 3:
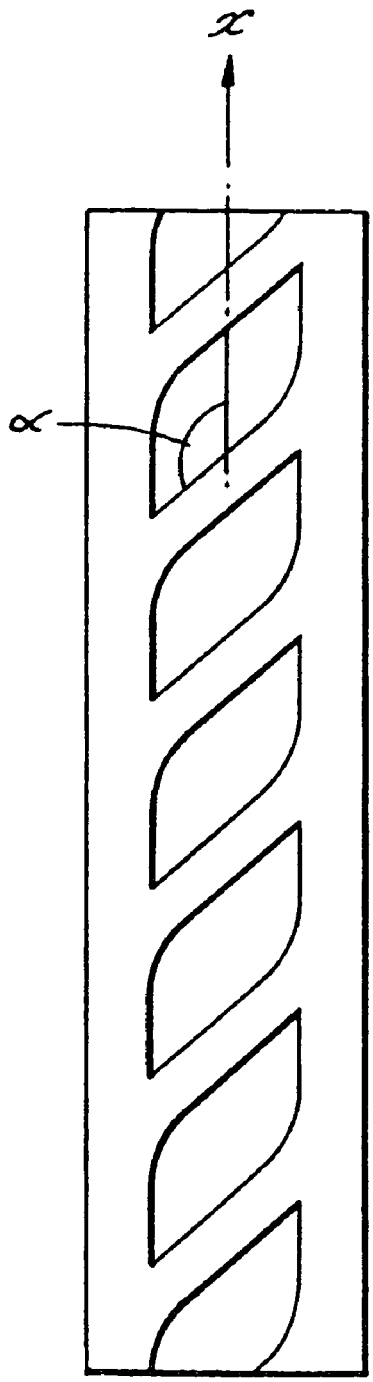
FIGS. 3 and 4 are sections of cylinder mould covers having different embossed patterns for use in the method of the present invention.
Figure 4:
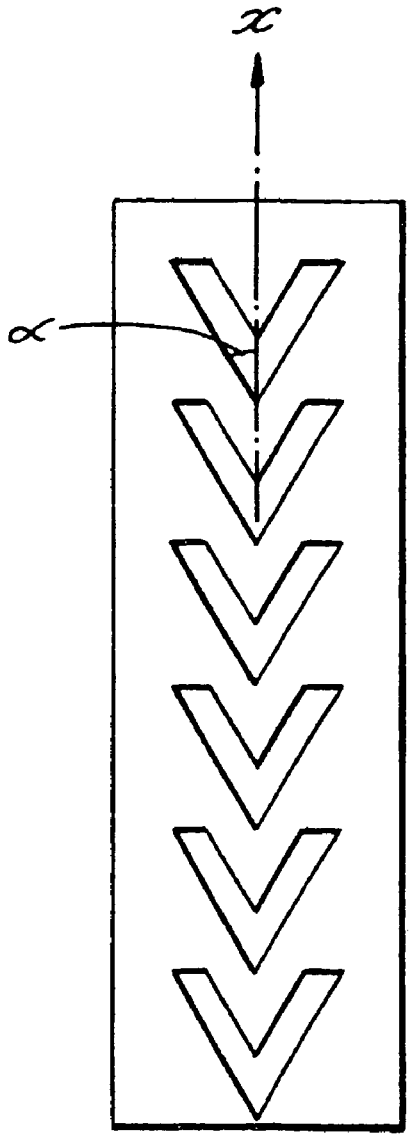
Figure 5:
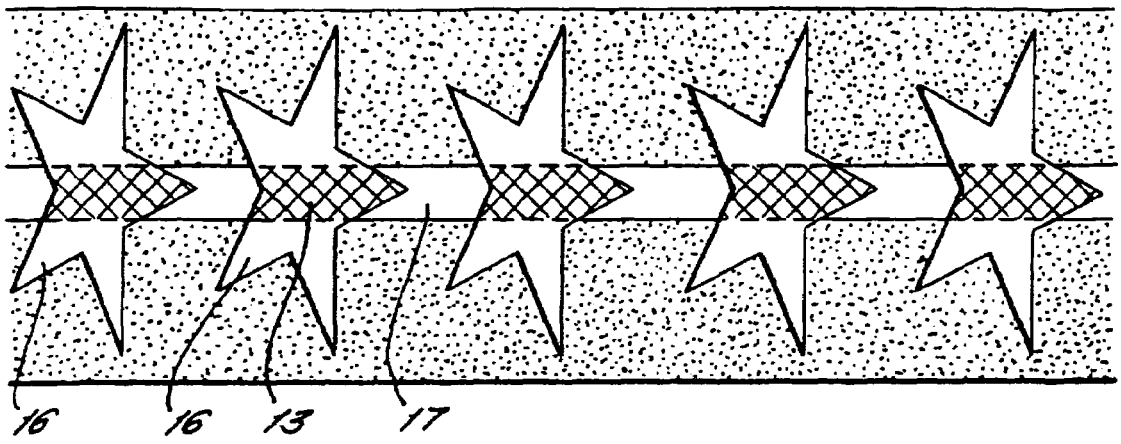
FIGS. 5, 6 and 7 are sections of alternative paper sheets to that of FIG. 2 made according to the present invention.
Figure 6:
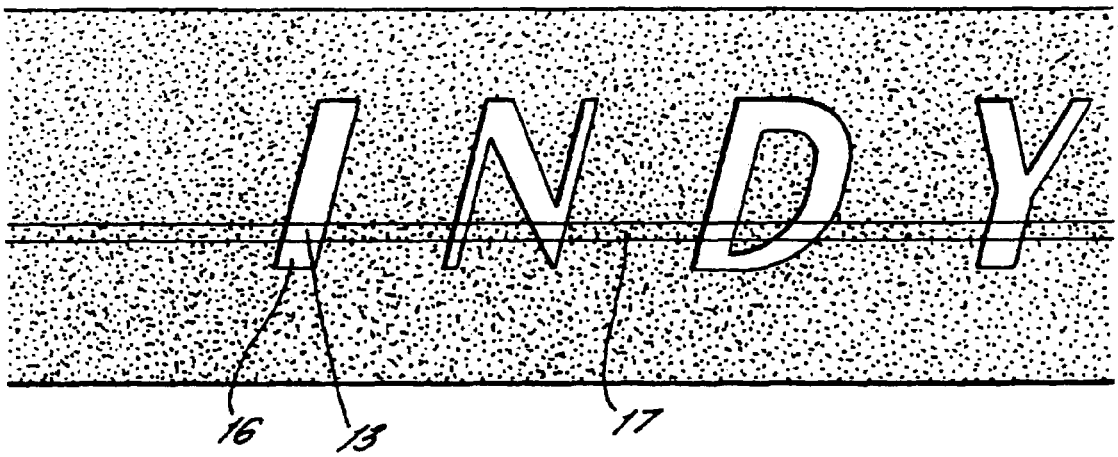
Figure 7:
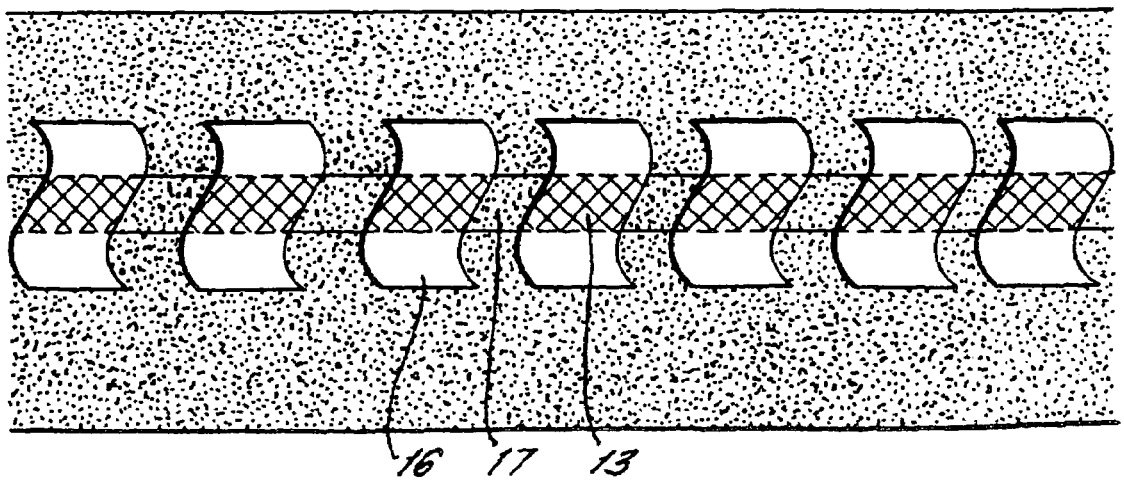

In FIG. 2 the windows 16, which correspond to the shape of the raised portions 12, are shown as being parallelograms. However, the shapes of the windows 16 can also be varied to include other straight line geometric patterns or even curves, as shown in FIG. 3, or they may comprise composite diagonal structures "V" or "W", one form of which is shown in FIG. 4. The embossing on a cylinder mould is used to produce windows which extend beyond the width of the elongate element 13. The patterns produced can also be a composite pattern of diagonals and/or curves which form indicia or text, examples of which are shown in FIGS. 5 to 7. In these cases the section of the leading (and possibly also the trailing) edges of the bridges 12, in the area occupied by the elongate element, must be at an angle other than 90° to the machine direction.

Although the method of the present invention is particularly advantageous when used on a single felted press, to overcome the specific disadvantages described above, it can also be used on double felted presses.

The elongate element 13 can advantageously be used as an information carrier and/or can contain a wide variety of known security features. These may include the following;

- de-metallised designs, which may comprise areas of substantially removed metal to take advantage of the transparency of the base film and provide a large area of transparent window;
- holographic designs, which may comprise areas of full metal and half-tone screens to provide partial transparency and/or no metal. Under certain viewing conditions, with no metal, a holographic image is still visible;
- front to back print registration, in which features are printed which would clearly exhibit Moiré patterns from both front and back if a counterfeit were attempted.

Alternatively, such patterns could be produced on a transparent film prior to insertion of the element 13 into the paper as a security feature itself. The exact reproduction of such patterns are very difficult to mimic;

luminescent or magnetic materials;

With such a large area available, it is possible to combine many features together on a element 13.

In addition, the element 13 could be perforated with holes of various shapes to provide novel features or possibly machine readability, e.g. via airstreams.

The paper described above can be cut and printed to make all forms of documents, including security documents, such as banknotes, cheques, travellers cheques, identity cards, passports, bonds, security labels, stamps, vouchers etc.

The invention claimed is:

1. A method of manufacturing a fibrous sheet, the method comprising the steps of bringing an elongate flexible element having a width of at least 2 mm into contact with a moving support surface, depositing fibres onto the support surface to form a fibrous sheet which travels in a machine direction, said support surface having spaced portions which prevent the substantial deposition of fibres at those portions and form windows at spaced locations in one surface of the sheet separated by fibrous bridges covering the elongate flexible element, the shape of the windows being defined by the raised portions, said windows being wider than a transverse width of the elongate flexible element, the deposition of fibres being carried out in such a manner that as fibres are deposited onto the support surface, the elongate element is incorporated in the sheet, with regions of the element at least partially exposed in said windows, wherein at least a leading edge of the spaced portions, and therefore the windows, is at an angle, in the plane of the sheet, which is not 90° to the machine direction, such that water which is squeezed out of the sheet during manufacture is channeled along the windows away from the bridges to prevent splitting of the bridges, the method further comprising the step of transferring the sheet from the support surface by means of a couch roll for further processing, wherein each of said spaced portions is positioned relative to adjacent spaced portions such that said couch roll is always supported by at least one of said raised portions and does not fall in troughs between adjacent spaced portions.

2. A method as claimed in claim 1 in which the spaced portions are raised relative to adjacent areas of the support surface.

3. A method as claimed in claim 2 in which the spaced portions of the support surface are fluid permeable.

4. A method as claimed in claim 1 in which at least a leading edge of the spaced portions is at an angle between 30° and 60°to the machine direction.

5. A method as claimed in claim 4, in which at least a leading edge of the spaced portions is at an angle of 30° to the machine direction.

6. A method as claimed in claim 4 in which at least a leading edge of the spaced portions is at an angle of 45° to the machine direction.

7. A method as claimed in claim 4 in which at least a leading edge of the spaced portions is at an angle of 60° to the machine direction.

8. A method as claimed in claim 1 in which a trailing edge of the spaced portions is at an angle, in the plane of the sheet, which is not 90° to the machine direction.

9. A method as claimed in claim 1 in which at least a leading edge of each spaced portion is a straight line or consists of straight line segments at different angles to each other.

10. A method as claimed in claim 1 in which a trailing edge of each spaced portion is a straight line or consists of straight line segments at different angles to each other.

11. A method as claimed in claim 1 in which at least a leading edge of the spaced portions is curved or has one or more curved portions.

12. A method as claimed in claim 1 in which a trailing edge of the spaced portions is curved or has one or more curved portions.

13. A method of manufacturing a fibrous sheet, the method comprising the steps of bringing an elongate flexible element having a width of at least 2 mm into contact with a moving support surface, depositing fibres onto the support surface to form a fibrous sheet which travels in a machine direction, said support surface having spaced portions which prevent the substantial deposition of fibres at those portions and form windows at spaced locations in one surface of the sheet, separated by fibrous bridges covering the element, the shape and occurrence of the windows being defined by the raised portions, said windows being wider than a transverse width of the elongate flexible element, the deposition of fibres being carried out in such a manner that as fibres are deposited onto the support surface, the elongate element is incorporated in the sheet, with regions of the element at least partially exposed in said windows, wherein at least a leading edge of the spaced portions, and therefore the windows, is at an angle, in the plane of the sheet, which is not 90° to the machine direction, such that water which is squeezed out of the sheet during manufacture is channeled along the windows away from the bridges to prevent splitting of the bridges, the method further comprising the step of transferring the sheet from the support surface by means of a couch roll for further processing, wherein each of said spaced portions is positioned relative to adjacent spaced portions such that said couch roll is always supported by at least one of said raised portions and does not fall in troughs between adjacent spaced portions.

* * * * *